US006938956B1

(12) United States Patent
Piretti

(10) Patent No.: US 6,938,956 B1
(45) Date of Patent: Sep. 6, 2005

(54) CHAIR BACKREST

(75) Inventor: Giancarlo Piretti, Bologna (IT)

(73) Assignee: Pro-Cord SPA, Bologna (IT)

( * ) Notice: Subject to any disclaimer, the term of this patent is extended or adjusted under 35 U.S.C. 154(b) by 0 days.

(21) Appl. No.: 10/655,127

(22) Filed: Sep. 5, 2003

(30) Foreign Application Priority Data

Sep. 6, 2002 (IT) ..... TO2002A0775

(51) Int. Cl.[7] ..... A47C 3/025
(52) U.S. Cl. ..... 297/284.7; 297/230.14
(58) Field of Search ..... 297/284.7, 353, 297/284.4, 354.12, 410, 452.3, 230.14

(56) References Cited

U.S. PATENT DOCUMENTS 5,112,106 A * 5/1992 Asbjornsen et al. ..... 297/284.7
5,228,747 A * 7/1993 Greene ..... 297/284.3
5,344,211 A * 9/1994 Adat et al. ..... 297/230.14
D359,192 S * 6/1995 Franklin, III ..... D6/606
5,460,427 A * 10/1995 Serber ..... 297/216.19
5,567,011 A * 10/1996 Sessini ..... 297/284.7
D401,801 S * 12/1998 Zacharkow ..... D6/601

* cited by examiner

*Primary Examiner*—Peter M. Cuomo
*Assistant Examiner*—Stephen Vu
(74) *Attorney, Agent, or Firm*—Sughrue Mion, PLLC

(57) ABSTRACT

Chair backrest, comprising a support structure (12), an upper backrest member (30) connected in oscillating fashion to said support structure (12), a lower backrest member (32), and a connecting element (80) which is fixed relative to one of said backrest members (32) and able to slide telescopically inside the other backrest member (30), the connecting element (80) having at least one elastically deformable zone (82) and being able to apply an elastic force to said backrest members (30, 32) as a result of a variation in the relative angular position of said backrest members (30, 32).

10 Claims, 7 Drawing Sheets

32
72
78
76
74
60
28
20
66
64
62
68
70
14

34
36
42
40
38
44
48
50
52
56
54
22
30

92
94
88
90

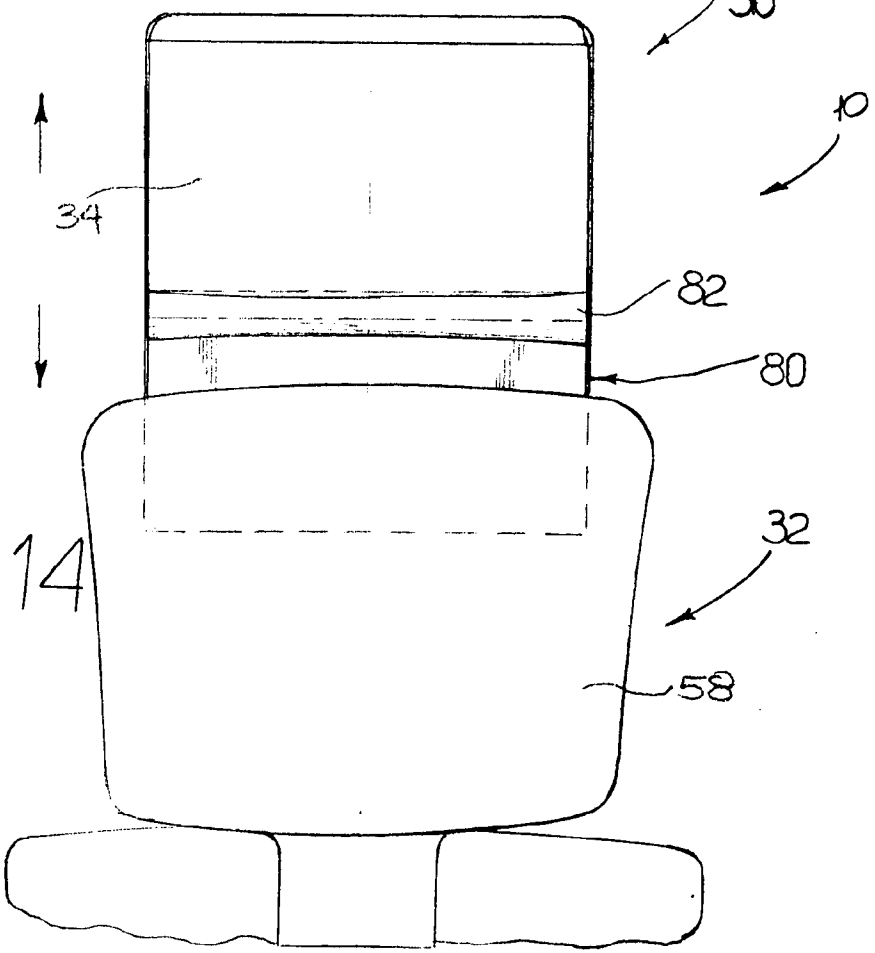
FIG. 14
FIG. 13
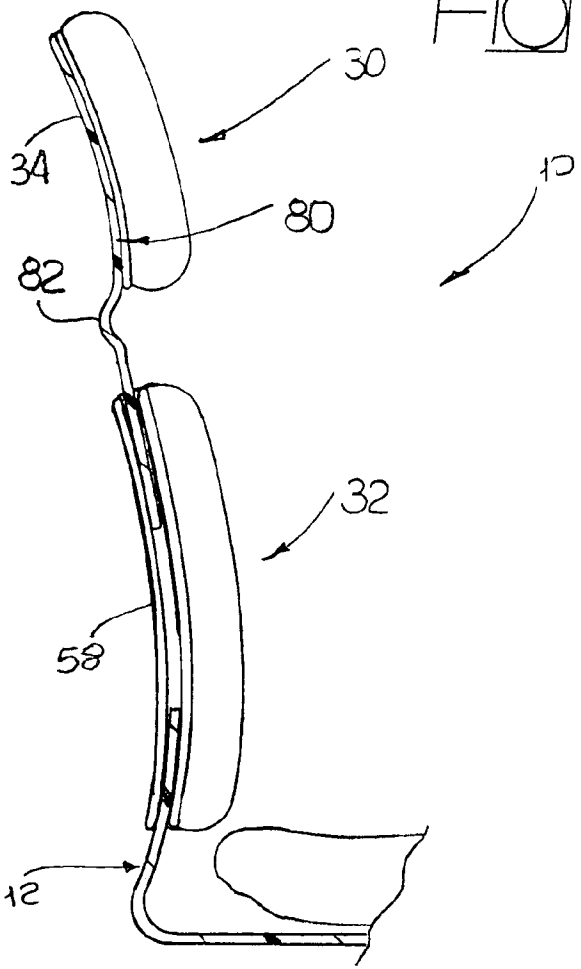

CHAIR BACKREST

BACKGROUND OF THE INVENTION

The present invention relates to a chair backrest of the type defined in the preamble of the main claim.

The document WO-A-0193723 by the same Applicant describes a chair backrest comprising a support structure bearing an upper backrest member and a lower backrest member, oscillating in mutually independent fashion about respective mutually parallel transverse axes. The position of the lower backrest member is adjustable in the vertical direction and each of the two backrest elements is associated to respective elastic means which maintain the two backrest elements in a predetermined resting position and produce an elastic reaction force which tends to oppose the oscillation of the backrest members about the respective transverse axes.

SUMMARY OF THE INVENTION

The object of the present invention is to provide an enhanced chair backrest which, compared to the prior art, is simpler, composed by a smaller number of components, and has better comfort characteristics.

According to the present invention, said object is achieved by a chair backrest having the characteristics set out in the main claim.

BRIEF DESCRIPTION OF THE DRAWINGS

The present invention shall now be described in detail with reference to the accompanying drawings, provided purely by way of non limiting example, in which:

FIG. 13 is a schematic side view showing an additional variation of the backrest according to the invention, and FIG. 14 is a front view of the backrest of FIG. 13.

DETAILED DESCRIPTION OF THE INVENTION

Figures 1, 2:
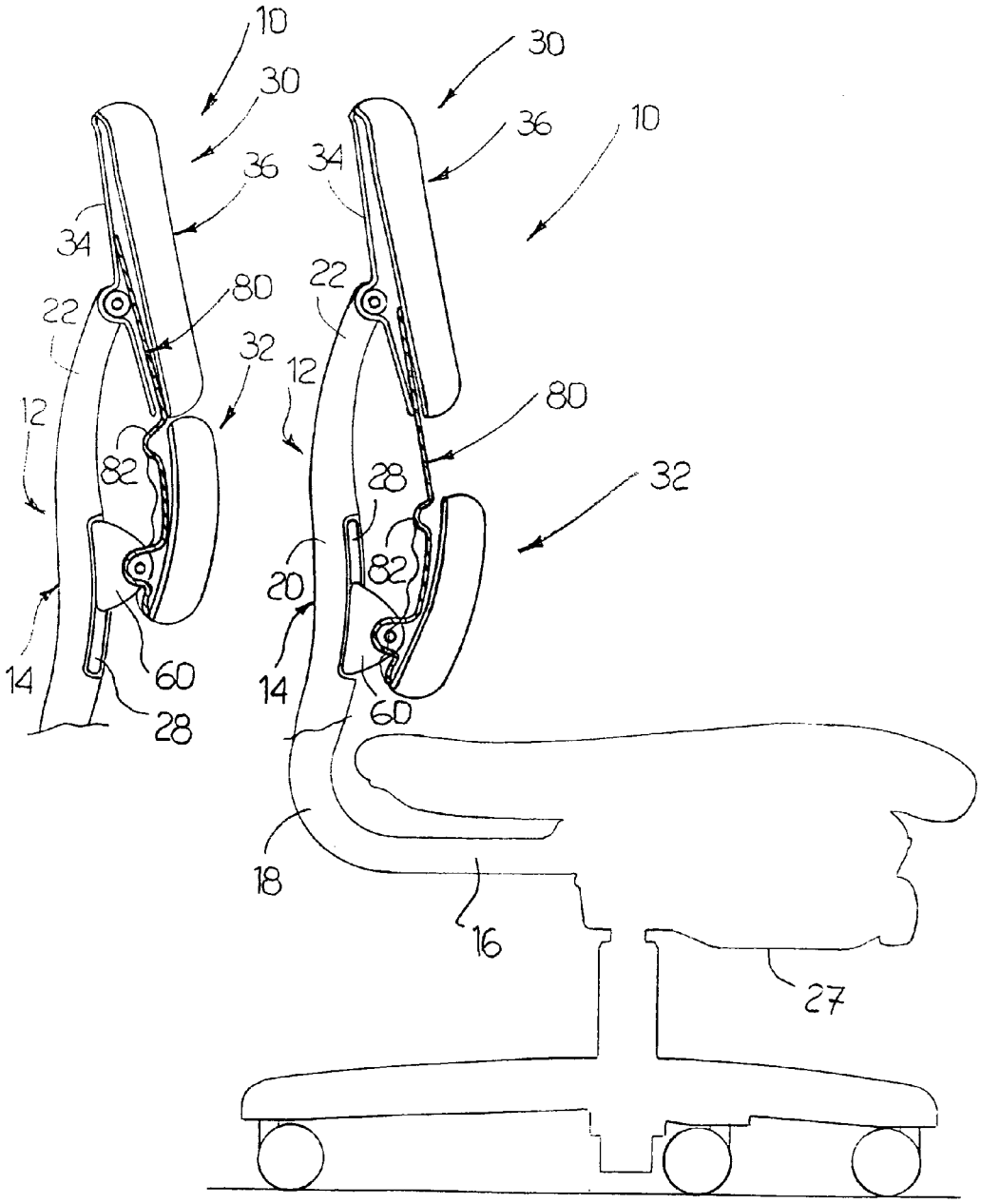
FIGS. 1 and 2 are lateral sections of a backrest according to the present invention in two operative positions.
Figure 4:
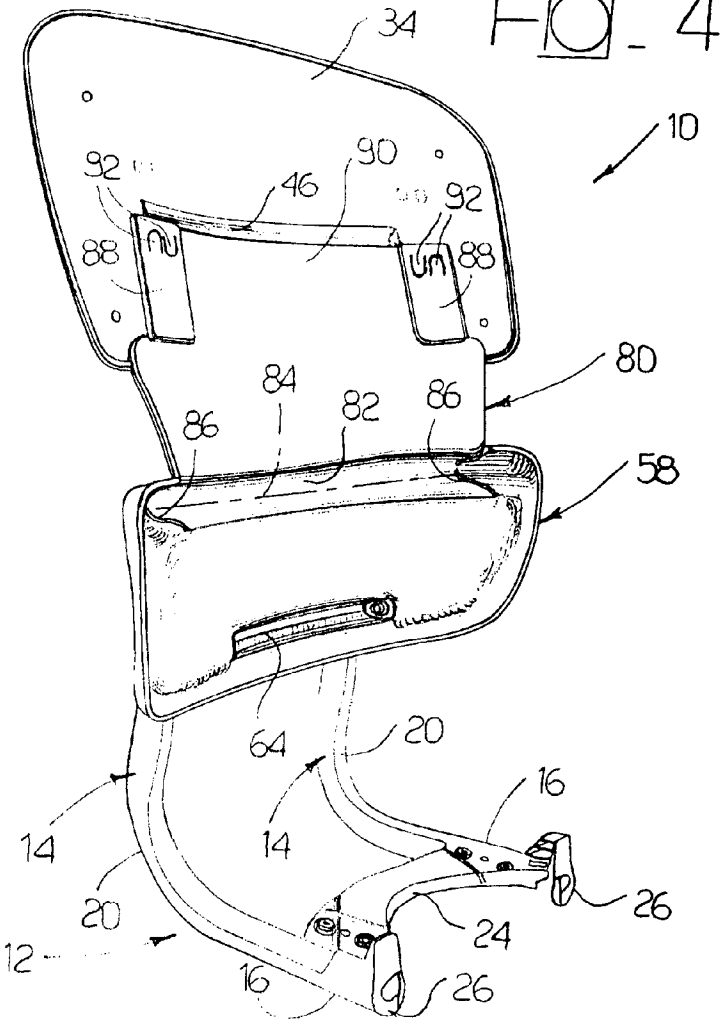
FIG. 4 is a front perspective view of the backrest of FIG. 3, without the stuffing elements.

With reference to FIGS. 1 through 5, the reference number 10 designates a backrest according to a first embodiment of the present invention. The backrest 10 comprises a support structure 12 comprising two metal uprights 14 distanced from each other. As shown particularly in FIGS. 3 and 4, each upright 14 has, from the bottom to the top, a horizontal segment 16, a curved portion 18, an intermediate portion 20 and an upper end portion 22. The two uprights 14 are mutually connected by means of a transverse element 24 which extends between the lower horizontal segments 16.

The ends of the lower horizontal segments 16 of the uprights 14 have fastening sections 26 whereby the backrest 10 is connected to a chair structure. The backrest 10 can for instance be connected to a mechanism, schematically designated by the reference 27 in FIG. 2, which allows to obtain a synchronised oscillation of the seat and of the backrest, for instance of the type described in the document EP 1057429 by the same Applicant.

Figure 3:
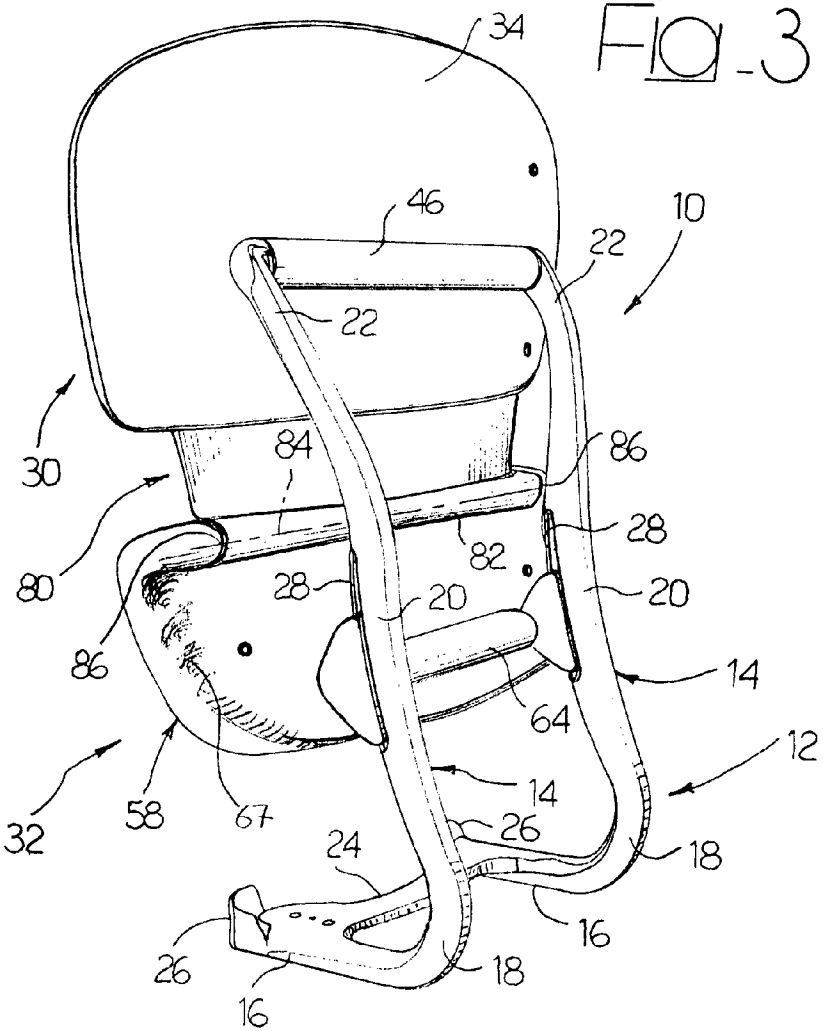
FIG. 3 is a rear perspective view of a backrest according to the present invention.
Figure 5:
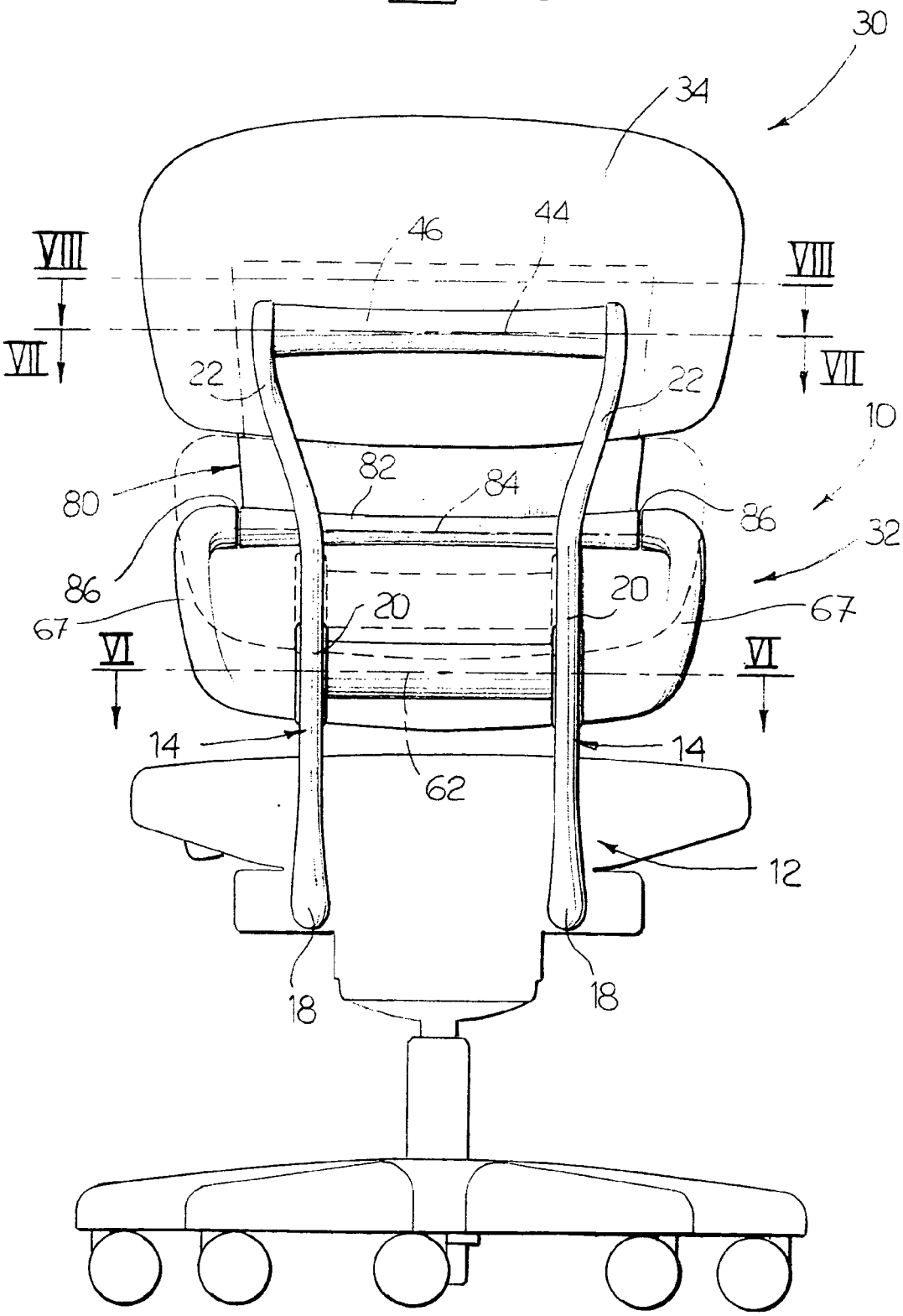
FIG. 5 is a rear view of a chair provided with a backrest according to the present invention.

As shown in particular in FIG. 5, the intermediate portions 20 of the two uprights 14 are mutually parallel whilst the upper end portions 22 widen outwardly. As shown in FIGS. 1 through 3, the intermediate portions 20 of the uprights 14 have guiding grooves 28 whose function shall become readily apparent hereafter. As shown in FIGS. 1 and 2, in a side view the intermediate portions 20 of the uprights 14 are slightly arched with their convexity oriented forwards.

The backrest 10 comprises an upper backrest member 30 and a lower backrest member 32. The upper backrest member 30 comprises a rear support body 34 preferably constituted by moulded plastic material having substantially the shape of a shallow shell with its concavity oriented forwards. As shown in greater detail in FIGS. 7 and 8, the upper backrest member 30 comprises a stuffing element 36 fastened to the rear support body 34. The stuffing element 36 comprises a rigid support plate 38 bearing a stuffing layer 40 and a cover layer 42.

Figures 6, 7, 8:
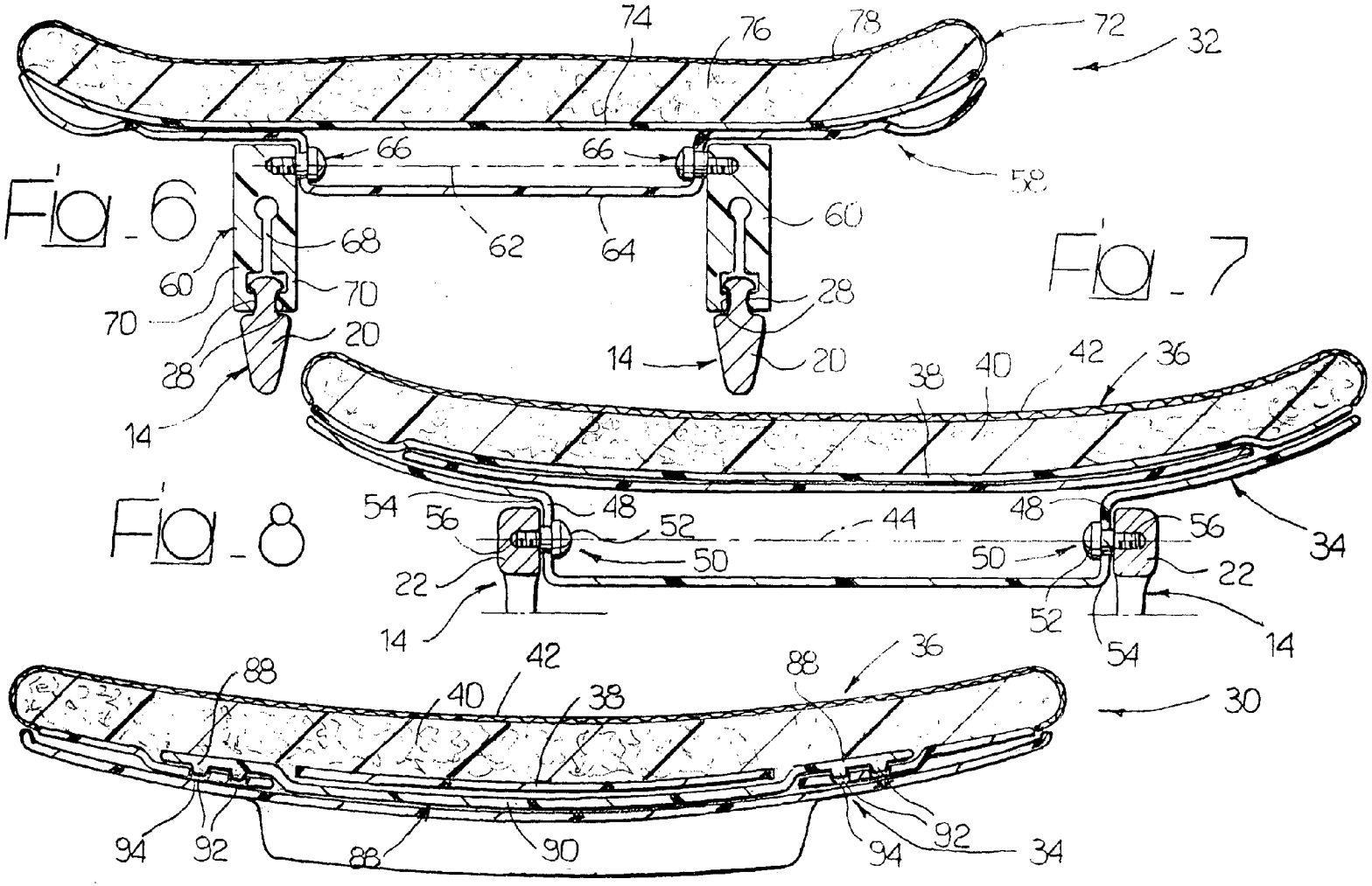
FIGS. 6, 7 and 8 are sections according to the lines VI—VI, VII—VII and VIII—VIII of FIG. 5, FIGS. 9 and 10 are schematic lateral sections showing a second embodiment of a backrest according to the present invention in two operative positions.

The rear support body 34 of the upper backrest member 30 is articulated to the upper end portions 22 of the uprights 14 about a transverse axis 44. The articulated connection between the rear support body 34 and the upper end portions 22 of the uprights 14 is preferably constructed as shown in FIG. 7. The rear support body 34 has an integral projecting portion 46 with substantially semi-cylindrical shape with two lateral walls 48 facing and situated internally with respect to the upper end portions 22 of the uprights 14. The lateral walls 48 of the projecting portion 46 are provided with holes with mutually aligned axes, engaged by respective screws 50. Each screw 50 has a head 52 situated inside the projecting portion 46, an articulation portion 54 which engages the hole of the wall 48 and a threaded segment 56 which engages a corresponding threaded hole of the upper end 22 of the upright 14.

With reference to FIGS. 1 through 6, the lower backrest member 32 comprises a rear support body 58 preferably made of moulded plastic material. The rear support body 58 has the shape of a shell, with its concavity oriented forwards. The rear support body 58 is articulated to a pair of sliding blocks 60 about a second transverse axis 62 parallel to the axis of articulation 44 of the upper backrest member 30. The sliding blocks 60 slidably engage in the vertical direction the intermediate portions 20 of the uprights 14. With reference in particular to FIG. 6, the articulated connection between the rear support body 58 and the sliding blocks 60 is preferably achieved similarly to that of the upper backrest member 30. In this case, too, the rear support body 58 has a projecting portion 64 with substantially semi-cylindrical shape which is articulated to the sliding blocks 60 by means of two screws 66 identical to the screws 50 described above. The rear support body is preferably provided on its rear surface with lateral grip zones 67, able to be gripped manually by the user to adjust the vertical position of the lower backrest member 32.

As shown in FIG. 6, each of the two sliding blocks 60 is preferably constructed in such a was as to engage in snap-in fashion the guiding grooves 28 formed on the intermediate portion 20 of the respective upright 14. Each sliding block 60 has a cavity 68 which forms two snap-in engagement portions 70 which engage in freely sliding fashion the guiding grooves 28. The sliding blocks 60 are free to slide along the intermediate portions 20 of the uprights 14. The upper and lower ends of the grooves 28 define the upper and lower end stop positions of the sliding blocks 60.

Still with reference to FIG. 6, the lower backrest member 32 comprises a stuffing element 72 which is fastened to the rear support body 58. The stuffing element 72 comprises a rigid support plate 74 bearing a stuffing layer 76 and a covering layer 78.

The backrest 10 according to the present invention is provided with a connecting element 80 which structurally connects the upper backrest member 30 and the lower backrest member 32. In the embodiment illustrated in the figures, the connecting element 80 has the shape of an arched plate integrally obtained with the rear support body 58 of the lower backrest member 32. The connecting element 80 projects from the upper edge of the rear support body 58 and is telescopically movable in the vertical direction within the upper backrest member 30. The connecting element 80 serves the purpose of applying an elastic reaction force between the two backrest elements 30, 32 as a result of a variation in their relative angular position. The connecting element 80 has an elastically deformable zone 82, capable of being deformed by flexing. The deformable zone 82 is formed by a semi-cylindrical projection with rectilinear generatrices, able to flex along a rectilinear line 84 parallel to the articulation axes 44 and 62. The flexion line 84 is positioned above the articulation axis 62 of the lower backrest member 32 and extends substantially in correspondence with the upper edge of the backrest element 32. The elastically deformable zone 82 is laterally delimited by two through cuts 86. The part of the connecting element 80 which extends above the deformable zone 82 has an arched shaped with a curvature corresponding to that of the rear support body 34 of the upper backrest member 30. This part of the connecting element 80 is not deformable because its arched shape makes it rigid. The elastic and flexion deformations of the connecting element 80 are therefore concentrated on the rectilinear line 84 of the deformable area 82.

The upper part of the connecting element 80 comprises two integral wings 88 slightly projecting towards the front part of the backrest relative to the central part 90 of the connecting element 80. The wings 88 are provided with projecting teeth 92. As shown in FIG. 8, the teeth 92 are destined to co-operate with holes or incisions 94 formed in the inner part of the support plate 38 of the upper backrest member 30 and positioned at regular intervals in the vertical direction in such a way as to form various retaining positions.

A shown in FIGS. 1 and 2, the position of the lower backrest member 32 is adjustable in the vertical direction between the fully raised position shown in FIG. 1 and the fully lowered position shown in FIG. 2. The lower backrest member 32 can also assume intermediate positions between the two end positions shown in FIGS. 1 and 2. The engagement of the teeth 92 with the holes or incisions 94 as shown in FIG. 8 retains the lower backrest member 32 in the selected position. To change the vertical position of the lower backrest member 32 the user grips the lateral grip portions 67 and moves the backrest member upwards or downwards with a sufficient force to overcome the retaining action of the teeth 92. The backrest member is stably retained in the selected position by the engagement between the teeth 92 and the holes 94.

When the user bears with his/her back against the backrest 10, the two backrest members 30, 32 oscillate about the respective axes of articulation and are automatically adapted to the shape of the user's back. The change in relative angular position between the two backrest elements 30, 32 relative to the resting position, produces a flexion of the connecting element 80 along the elastic deformable zone 82. Said deformation produces an elastic reaction on the backrest members 30, 32 which produces a thrust against the user's back of an amplitude that is proportional to the flexion deformation of the connecting element 80. The connecting element 80 distributes the elastic reaction forces on both backrest members 30, 32 yielding a result that is particularly appreciated from the viewpoint of ergonomics and utilisation comfort.

FIGS. 9 through 12 show a variation of the backrest according to the present invention. Details corresponding to those described previously are designated with the same numerical references. Relative to the embodiment described above, in this embodiment the sliding blocks 60 which connect the lower backrest member 32 to the uprights 14 have been eliminated. In this variation the lower backrest member is borne only by the connecting element 80. Said connecting element is constructed in a manner that is conceptually identical to the one described above. In this case too it is possible to adjust the vertical position of the lower backrest member 32 making the connecting element 80 slide telescopically within the upper backrest member 30. The grip zones 67 are formed by projecting portions positioned along the lower edge of the lower backrest member 32. In this case too the connecting element 80 has an elastic deformable zone 82 with a rectilinear deformation line along which are concentrated the flexion deformations of the connecting element 80.

Figure 9:
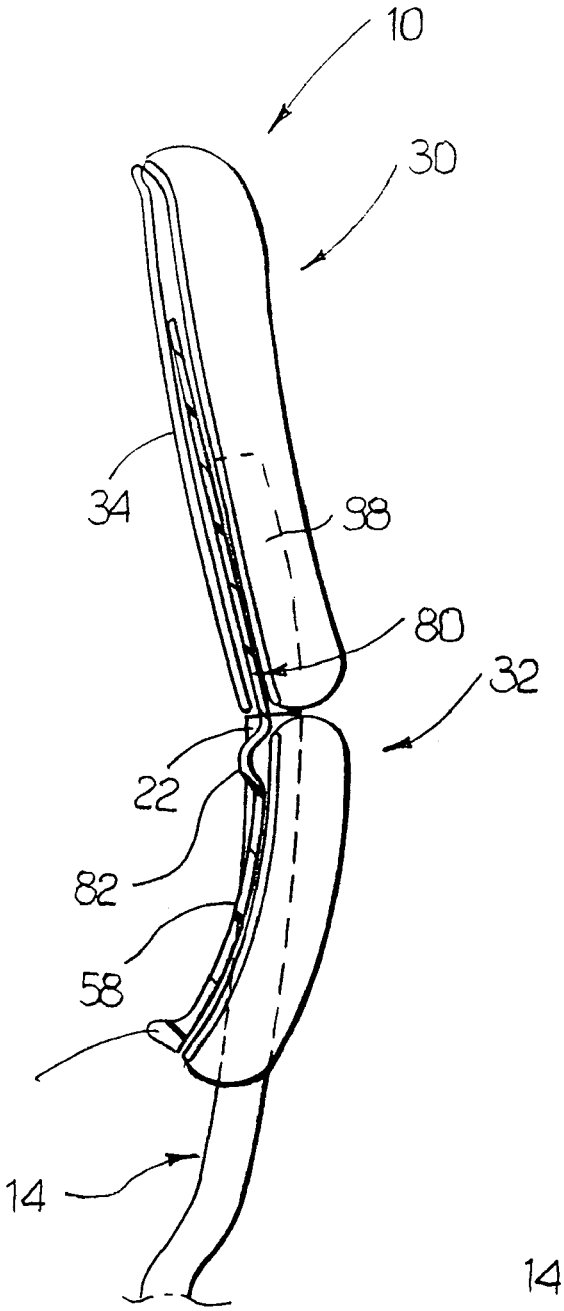
Figure 10:
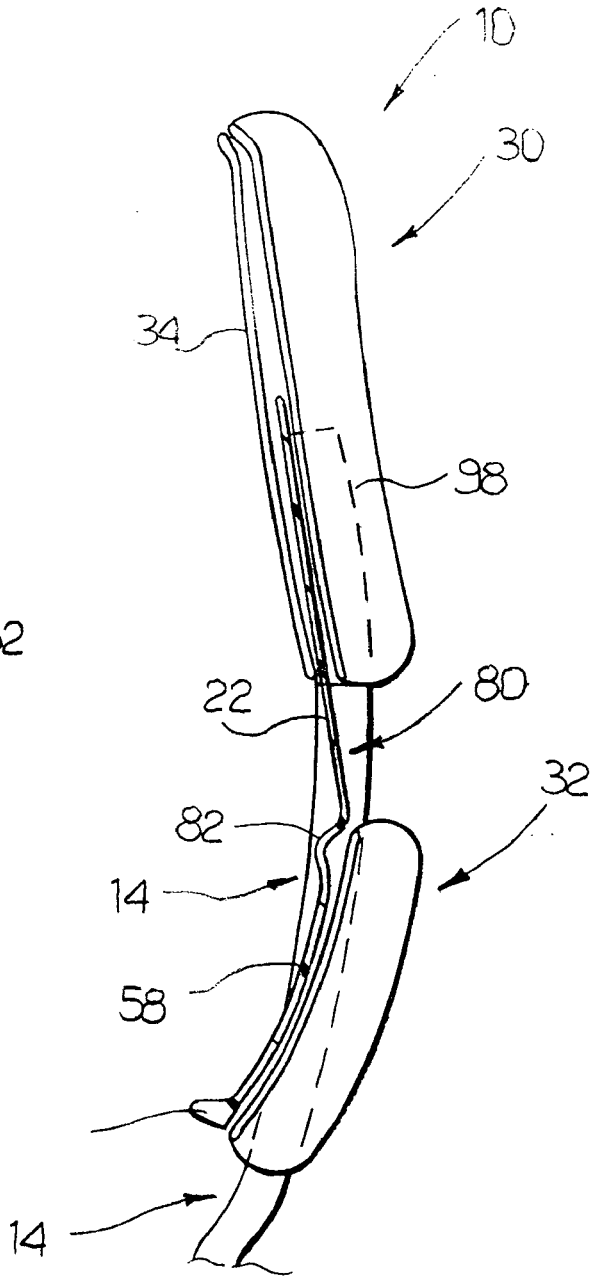
Figure 12:
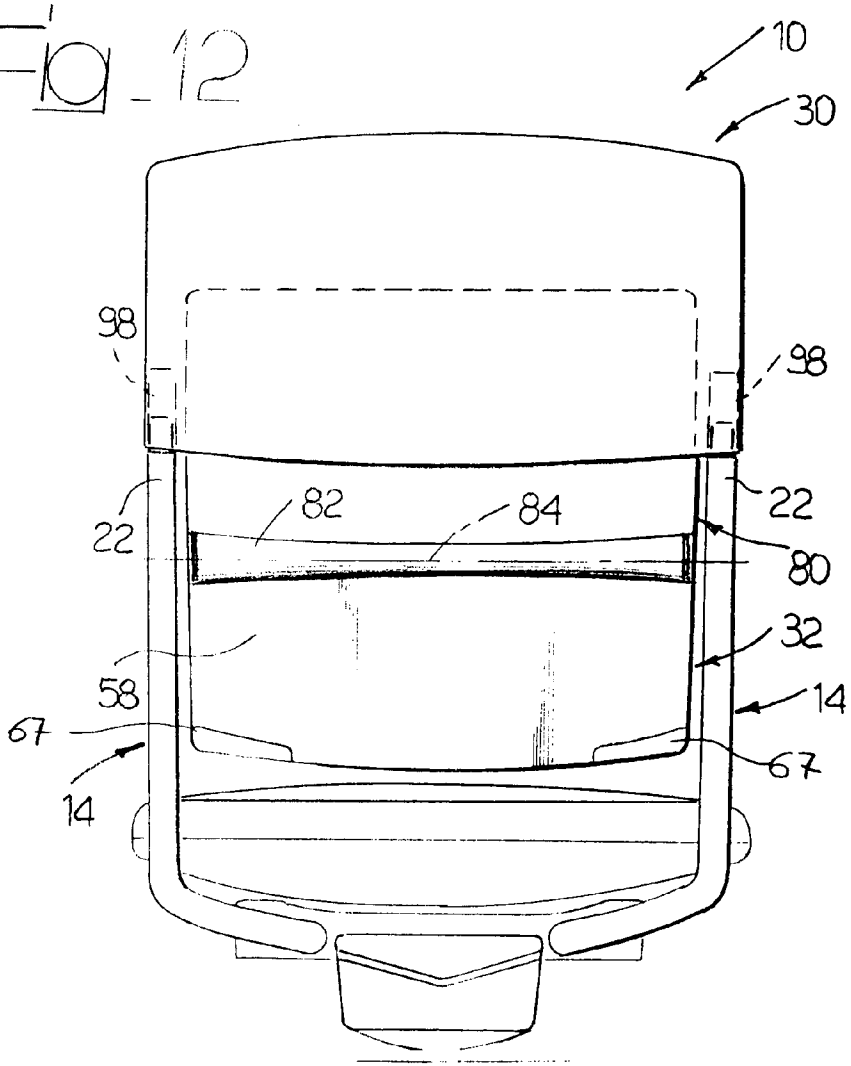
FIGS. 11 and 12 are schematic rear views showing the second embodiment of the backrest according to the invention in the two operative positions of FIGS. 9 and 10.
Figure 11:
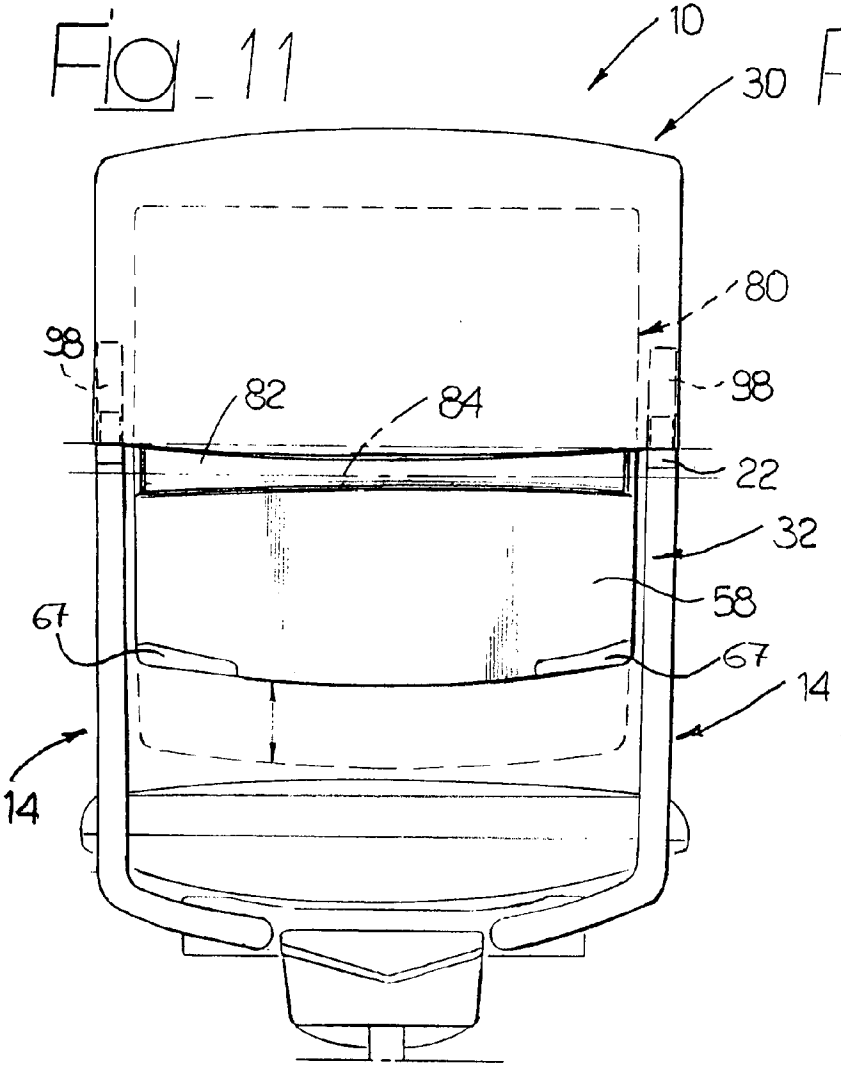

The upper backrest member 30 is connected to the upper ends of the uprights 14 by means of deformable elements for instance made of elastomeric material schematically designated by the reference 98, which allow the backrest member 30 to oscillate in similar fashion to the articulated connection of the embodiment described above. FIGS. 9 and 11 show the fully raised position of the lower backrest member 32 and FIGS. 10 and 12 show the fully lowered position of said backrest member. In this case, too, the backrest member 32 may assume a variety of intermediate positions between the two extreme positions. As in the embodiment described above, when the user bears against the backrest 10 the two backrest members 30, 32 are automatically adapted to the user's back and apply an elastic reaction proportional to the flexion deformation of the connecting element 80.

The backrest according to the present invention can be subject to numerous other variations. For example, the connecting element 80 could be borne by the upper backrest member 30 and could be movable telescopically within the lower backrest member 32. Moreover, the connecting element 80 instead of being integrally formed with the rear support body of one of the two backrest members 30, 32 could be constituted by a separate element fastened to one of the two backrest elements. The connecting element 80 could be provided with two or more elastic deformable zones 82.

FIGS. 13 and 14 show a variation of the present invention. In this variation, the lower backrest member 32 can be fixed or oscillating relative to the base structure 12 and can be constructed in a single structural member or in two parts as described above. The upper backrest member 30 is constructed in the form of a headrest and comprises a connecting element 80 able to slide telescopically inside the lower backrest member 32. The connecting element 80 can be fastened to the headrest 30 or can be formed integrally with the rear support body 34 of the headrest. The connecting element 80 is able to slide relative to the lower backrest member 32 to allow adjusting the vertical position of the backrest. The connecting element 80 is provided with retaining means which co-operate with the lower backrest member 32 to retain the backrest in the selected vertical position. As described above, a connecting element 80 has the shape of an arched plate and has an elastic deformable zone 82 which allows the backrest to oscillate about a transverse axis when the user presses his/her head backwards.

What is claimed is:

1. A chair backrest, comprising:

a support structure, an upper backrest member connected in oscillating fashion to said support structure, and a lower backrest member, a connecting element which is fixed relative to one of said backrest members and able to slide telescopically inside the other backrest member, said connecting element having at least one elastically deformable zone and being able to apply an elastic force to at least one of the backrest members as a result of a variation in the relative to angular position of said backrest members, wherein the upper backrest member is articulated to said support structure about a first transverse axis;

wherein said lower backrest is articulated to said support structure about a second transverse axis parallel to said first transverse axis; and wherein said second axis of articulation is borne by a pair of sliding blocks which engage in sliding fashion in the vertical direction a pair of uprights.

2. The backrest as claimed in claim 1, wherein said connecting element is provided with retaining means to retain the movable backrest in a vertical, position.

3. The backrest as claimed in claim 1, wherein said connecting element has a substantially arch shape.

4. The backrest as claimed in claim 3, wherein said elastically deformable zone is formed by a substantially semi-cylindrical projection having at least a rectilinear flexion line.

5. The backrest as claimed in claim 1, wherein one of said backrest members comprises a rear support body having an internal projecting portion forming said connecting element.

6. The backrest as claimed in claim 1, wherein the upper backrest member is connected to said support structure by means of a pair of elastically deformable elements.

7. The backrest as claimed in claim 1, wherein said lower backrest member is borne solely by said connecting element.

8. The backrest as claimed in claim 1, wherein said connecting element is fastened to the upper backrest member and is able to slide telescopically inside the lower backrest member.

9. The backrest as claimed in claim 8, wherein said upper backrest member is constructed in the form of a headrest.

10. A chair backrest, comprising:

a support structure;

an upper backrest member articulated to the support structure about a fixed horizontal axis, the upper backrest member having a hollow space extending vertically;

a lower backrest member vertically movable with respect to the upper backrest member; and a connecting element having a lower portion, an upper portion and a horizontal deformable portion separating the upper portion from the lower portion, said deformable portion allowing an elastic deformation between the upper portion and the lower portion, wherein the lower portion of the connecting element is fixed to the lower backrest member and the upper portion is telescopically slidable inside said hollow space of the upper backrest portion.

* * * * *